US007500473B2

(12) United States Patent
Kobayashi et al.

(10) Patent No.: US 7,500,473 B2
(45) Date of Patent: Mar. 10, 2009

(54) VEHICLE FUEL SUPPLY DEVICE

(75) Inventors: Kazuhiro Kobayashi, Saitama (JP); Takeaki Nakajima, Saitama (JP); Shoichi Hokazono, Saitama (JP); Shinya Murabayashi, Saitama (JP); Hideharu Yamazaki, Saitama (JP); Kenji Hirose, Saitama (JP); Takeshi Kumakura, Saitama (JP); Shukoh Terata, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/079,346

(22) Filed: Mar. 26, 2008

(65) Prior Publication Data

US 2008/0236550 A1 Oct. 2, 2008

(51) Int. Cl.
*F02M 37/04* (2006.01)

(52) U.S. Cl. ..... 123/509; 137/565.29

(58) Field of Classification Search ..... 123/509, 123/510, 511, 457, 565.29
See application file for complete search history.

(56) References Cited

U.S. PATENT DOCUMENTS

| | | | | |
|---|---|---|---|---|
| 5,979,485 | A * | 11/1999 | Tuckey et al. | 137/143 |
| 6,276,342 | B1 | 8/2001 | Sinz et al. | |
| 6,283,142 | B1 * | 9/2001 | Wheeler et al. | 137/265 |
| 6,371,153 | B1 * | 4/2002 | Fischerkeller et al. | 137/265 |
| 6,607,005 | B2 * | 8/2003 | Viebahn et al. | 137/574 |
| 6,776,141 | B2 * | 8/2004 | Hamada et al. | 123/458 |
| 6,871,640 | B2 * | 3/2005 | Atwood et al. | 123/509 |
| 6,907,899 | B2 * | 6/2005 | Yu et al. | 137/565.22 |
| 7,066,153 | B2 * | 6/2006 | Vitalis et al. | 123/514 |
| 7,069,913 | B1 * | 7/2006 | Crary | 123/509 |
| 7,069,914 | B2 * | 7/2006 | Nagata | 123/509 |
| 7,234,451 | B2 * | 6/2007 | Betz et al. | 123/509 |
| 7,303,378 | B2 * | 12/2007 | Kleppner et al. | 417/87 |
| 2001/0023687 | A1 * | 9/2001 | Ushigome | 123/509 |
| 2002/0148510 | A1 * | 10/2002 | Viebahn et al. | 137/574 |
| 2004/0139946 | A1 * | 7/2004 | Hamada et al. | 123/458 |
| 2004/0140009 | A1 * | 7/2004 | Yu et al. | 137/565.22 |
| 2004/0177886 | A1 * | 9/2004 | Nagata et al. | 137/571 |
| 2004/0182454 | A1 * | 9/2004 | Atwood et al. | 137/574 |
| 2004/0219029 | A1 * | 11/2004 | Kleppner et al. | 417/77 |
| 2005/0045159 | A1 * | 3/2005 | Honda et al. | 123/509 |
| 2005/0178367 | A1 * | 8/2005 | Wolters et al. | 123/514 |

(Continued)

FOREIGN PATENT DOCUMENTS

| | | |
|---|---|---|
| DE | 100 01 829 A 1 | 7/2001 |

(Continued)

*Primary Examiner*—Thomas N Moulis
(74) *Attorney, Agent, or Firm*—Carrier, Blackman & Associates P.C.; Joseph P. Carrier; William D. Blackman

(57) ABSTRACT

A vehicle fuel supply device including a saddle-shaped fuel tank comprised of a main chamber and an auxiliary chamber. A reservoir is disposed within the main chamber. A main pump is provided within the reservoir. A sub-pump is detachably provided within the reservoir. The fuel in the reservoir is drawn up by an operation of the main pump to supply fuel to an engine. A portion of the drawn-up fuel is utilized to generate a negative pressure, the negative pressure is utilized to transfer the fuel in the auxiliary chamber to the reservoir, and the negative pressure is utilized to introduce the fuel in the main chamber into the reservoir.

3 Claims, 6 Drawing Sheets

U.S. PATENT DOCUMENTS

| | | | | |
|---|---|---|---|---|
| 2005/0178853 | A1* | 8/2005 | Doble et al. | 239/302 |
| 2005/0183781 | A1* | 8/2005 | Vitalis et al. | 137/565.22 |
| 2006/0021603 | A1* | 2/2006 | Nagata | 123/514 |
| 2006/0065246 | A1 | 3/2006 | Zdroik | |
| 2007/0023014 | A1* | 2/2007 | Betz et al. | 123/509 |
| 2007/0189906 | A1* | 8/2007 | Palvolgyi | 417/36 |
| 2008/0184971 | A1* | 8/2008 | Lubinski et al. | 123/511 |

FOREIGN PATENT DOCUMENTS

| | | | |
|---|---|---|---|
| DE | 103 35 698 | A1 | 2/2005 |
| DE | 10 2005 003 590 | A1 | 8/2006 |
| DE | 10 2005 005 171 | A1 | 8/2006 |
| EP | 0 979 939 | A | 2/2000 |
| EP | 1 124 054 | A2 | 8/2001 |
| EP | 1 124 054 | A3 | 6/2002 |
| JP | 05-077578 | | 10/1993 |
| JP | 05-45818 | | 11/1993 |

* cited by examiner

VEHICLE FUEL SUPPLY DEVICE

FIELD OF THE INVENTION

The present invention relates to a vehicle fuel supply device for supplying an engine with fuel that is stored in a main chamber and an auxiliary chamber of a saddle-shaped fuel tank.

BACKGROUND OF THE INVENTION

Fuel tanks for vehicles include saddle fuel tanks in which the space for storing fuel is divided into a main chamber and an auxiliary chamber.

Known fuel supply devices that use a saddle fuel tank include the fuel supply device disclosed in Japanese Utility Model Application Laying-Open Publication No. 5-77578 (JP-U-05-77578 A). In this fuel supply device, a fuel pump is provided to a main chamber, and the fuel in an auxiliary chamber is directed to the main chamber using a jet pump (transfer means) in order to supply an engine with the fuel stored in the two chambers (main chamber and auxiliary chamber) of a saddle fuel tank.

The abovementioned fuel supply device is configured so that the fuel pump is driven to supply the fuel in the main chamber to the engine, and a portion of the supplied fuel is returned to the main chamber via the jet pump. By returning a portion of the supplied fuel to the main chamber via the jet pump, the inside of the jet pump is negatively pressurized, and the fuel in the auxiliary chamber is directed to the main chamber.

However, since only one fuel pump is provided to the main chamber in the fuel supply device according to JP-U-05-77578 A, the fuel supply device is difficult to adapt to a high-output engine that has a large amount of exhaust.

A fuel supply device provided with two fuel pumps in order to adapt to a high-output engine is disclosed in Japanese Utility Model Application Post-Exam Publication No. 5-45818 (JP-U-05-45818 B).

In the fuel supply device according to JP-U-05-45818 B, two fuel pumps are provided on both sides within the fuel tank, supply pipes are connected to the fuel pumps, and each supply pipe separately extends to the outside of the fuel tank.

Each extended supply pipe is connected to a fuel filter (strainer), and the fuel filters are connected to the engine via the fuel pipes.

According to this fuel supply device, the fuel necessary for a high-output engine can be supplied by simultaneously driving the two fuel pumps.

Among vehicles, a single type of body is sometimes provided with a high-output engine, a fuel-saving engine, or another engine having different specifications.

High-output engines usually have the highest fuel consumption.

Fuel-saving engines also have a low maximum fuel consumption.

The number of fuel pumps provided to the fuel supply device disclosed in JP-U-05-45818 B may be varied in order to adapt to these different specifications of engines.

Specifically, two fuel pumps may be used in specifications provided with a high-output engine, and one fuel pump may be used in specifications provided with a fuel-saving engine.

In a common fuel tank, an open part for accommodating the fuel pump is formed at the top. After the fuel pump is accommodated through the open part, the open part is closed by a cover.

A supply pipe connected to the fuel pump is extended to the outside of the fuel tank via a passage hole in the cover and connected to the engine.

Two open parts for accommodating a fuel pump must be formed in the top in order to provide two fuel pumps inside the fuel tank. After the fuel pumps are accommodated in the two open parts, each open part is closed by a cover. The covers have passage holes formed therein for extending the supply pipes from the fuel pumps to the outside of the fuel tank. Specifically, covers are used that are specialized for fuel pumps.

When only one fuel pump is provided in accordance with a fuel-saving engine, another cover must be prepared that does not have a passage hole formed therein.

Furthermore, in the case of a saddle fuel tank provided with a main chamber and an auxiliary chamber, a means must be provided for transferring from the auxiliary chamber that does not have a fuel pump to the main chamber that does have a fuel pump.

It is therefore difficult to change the number of fuel pumps (i.e., the vehicle specifications) in accordance with the requirements of a high-output engine or a fuel-saving engine.

SUMMARY OF THE INVENTION

An object of the present invention is to provide a vehicle fuel supply device whereby the vehicle specifications can easily be modified according to the requirements of a high-output engine or a fuel-saving engine.

According to the present invention, there is provided a vehicle fuel supply device including a saddle-shaped fuel tank comprised of a main chamber and an auxiliary chamber for storing fuel to be fed to an engine, which vehicle fuel supply device comprising: a reservoir disposed within the main chamber; a main pump provided within the reservoir, for drawing up the fuel of the reservoir by driving in a period from a time of normal speed of the engine to a time of high engine speed; a sub-pump detachably provided within the reservoir, for drawing up the fuel in the reservoir by driving in the time of high engine speed; a strainer provided within the fuel tank and communicating with the main pump via a main pumping pipe, with the sub-pump via an auxiliary pumping pipe, and with the engine via a supply pipe; a pressure regulator communicating with the strainer, for adjusting an internal pressure of the strainer to a set value and returning excess fuel to the reservoir from among the fuel that is drawn up by the pumps; and transfer means for transferring the fuel from the auxiliary chamber into the reservoir within the main chamber.

In the present invention, the main pump communicates with the strainer via the main pumping pipe, and the sub-pump is communicates with the strainer via the auxiliary pumping pipe. The strainer is provided within the saddle fuel tank. The components relating to the main pump or the sub-pump (the main pumping pipe, the auxiliary pumping pipe, and other components) can thereby be accommodated within the saddle fuel tank.

Furthermore, the transfer means is already provided. Therefore, when the number of pumps (i.e., the vehicle specifications) is varied according to the requirements a high-output engine or a fuel-saving engine, the number of pumps can be changed merely by replacing parts within the saddle fuel tank. Consequently, since there is no need to replace the relatively large cover used in the saddle fuel tank according to a change in the number of pumps, the vehicle specifications can easily be modified according to the requirements of a high-output engine or a fuel-saving engine.

Preferably, the transfer means comprises: transfer jet means for, in a region from normal speed to high speed of the engine, utilizing a negative pressure generated through the use of excess fuel among the fuel drawn up by the main pump and transferring the fuel from the auxiliary chamber to the reservoir; and return jet means for, in the region from normal speed to high speed of the engine, generating a negative pressure by a portion of the excess fuel and utilizing the generated negative pressure to direct the fuel in the main chamber into the reservoir. The excess fuel branched by strainer herein may be fuel (dirty-side fuel) prior to passing through a filter provided in the strainer, or fuel (clean-side fuel) that has passed through the filter.

Consequently, by activating the transfer jet means and the return jet means in the region from the time of normal engine speed to the time of high engine speed, adequate fuel is allowed to remain in the reservoir even when there is minimal fuel remaining in the saddle fuel tank, and fuel can therefore be stably fed to the engine.

Desirably, the transfer means comprises: transfer jet means for utilizing a negative pressure generated through the use of excess fuel from the pressure regulator and transferring the fuel from the auxiliary chamber to the reservoir; and return jet means for, at the time of high engine speed, generating a negative pressure using a portion of the fuel drawn up by the sub-pump and utilizing the generated negative pressure to direct the fuel in the main chamber into the reservoir.

Normal engine speed is maintained, and the main pump is therefore driven alone, when the engine is started. At the time of engine startup, at the time when the fuel pressure is below a set value, and other times, the pressure regulator is not operated, and all of the fuel drawn up by the main pump can be fed to the engine. The fuel drawn up by the main pump can thereby be fed to the engine without modification, and better engine startup properties can be maintained even when the battery voltage is low during low-temperature startup, for example.

Furthermore, since the return jet means is provided for introducing the fuel in the main chamber into the reservoir using a portion of the fuel drawn up by the sub-pump when the engine speed is high, the fuel in the main chamber is introduced into the reservoir by the return jet means when the sub-pump is driven. Fuel can thereby be stably fed to the engine even when there is minimal remaining fuel stored in the saddle fuel tank in a high engine speed region.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
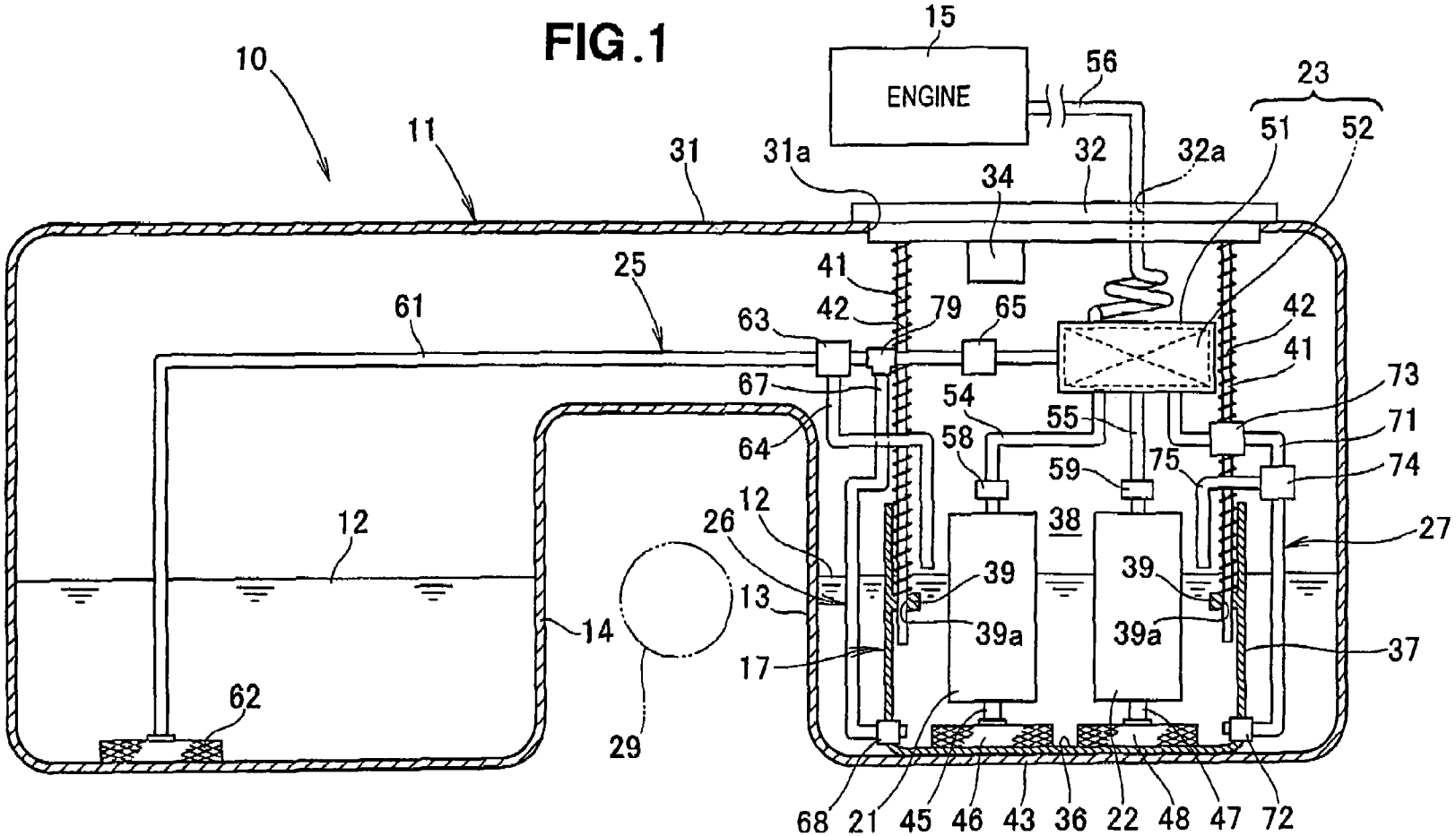
FIG. 1 is a schematic view showing a vehicle fuel supply device according to a first embodiment of the present invention.
Figure 2A:
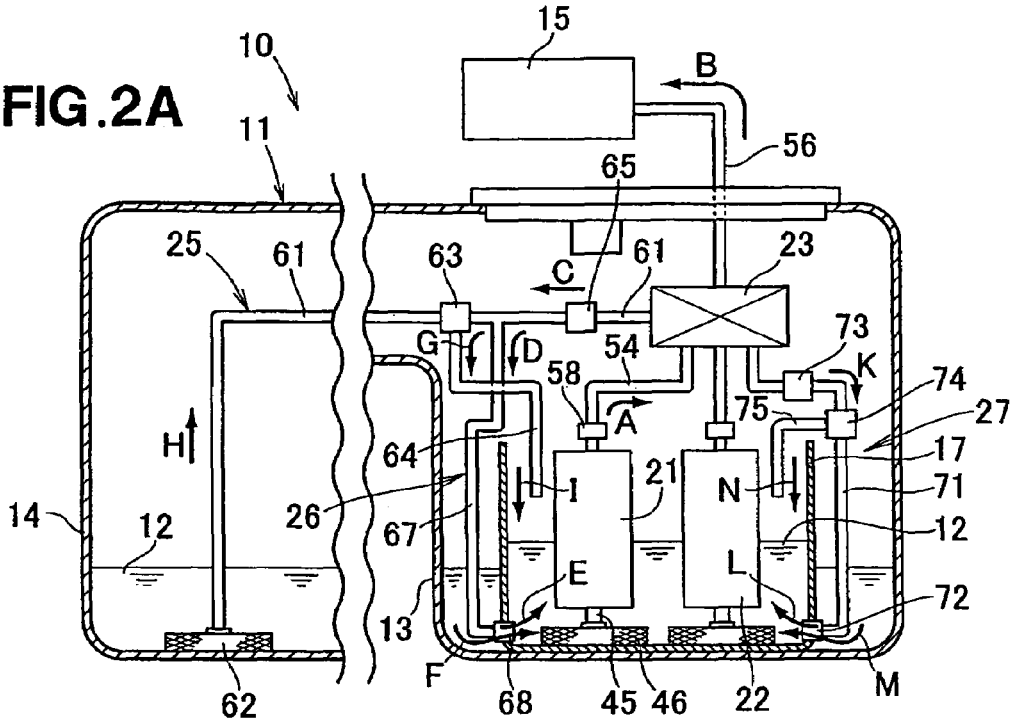
FIGS. 2A and 2B are diagrammatic views showing an example of feeding fuel to the engine by the fuel supply device according to the first embodiment.
Figure 2B:
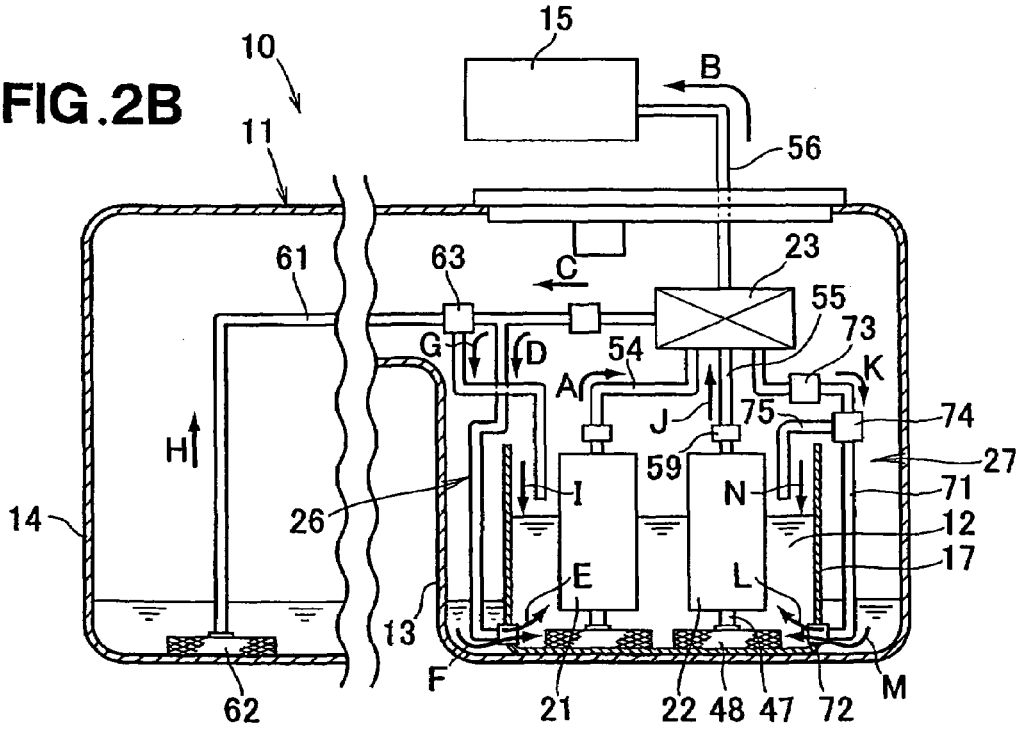
Figure 3:
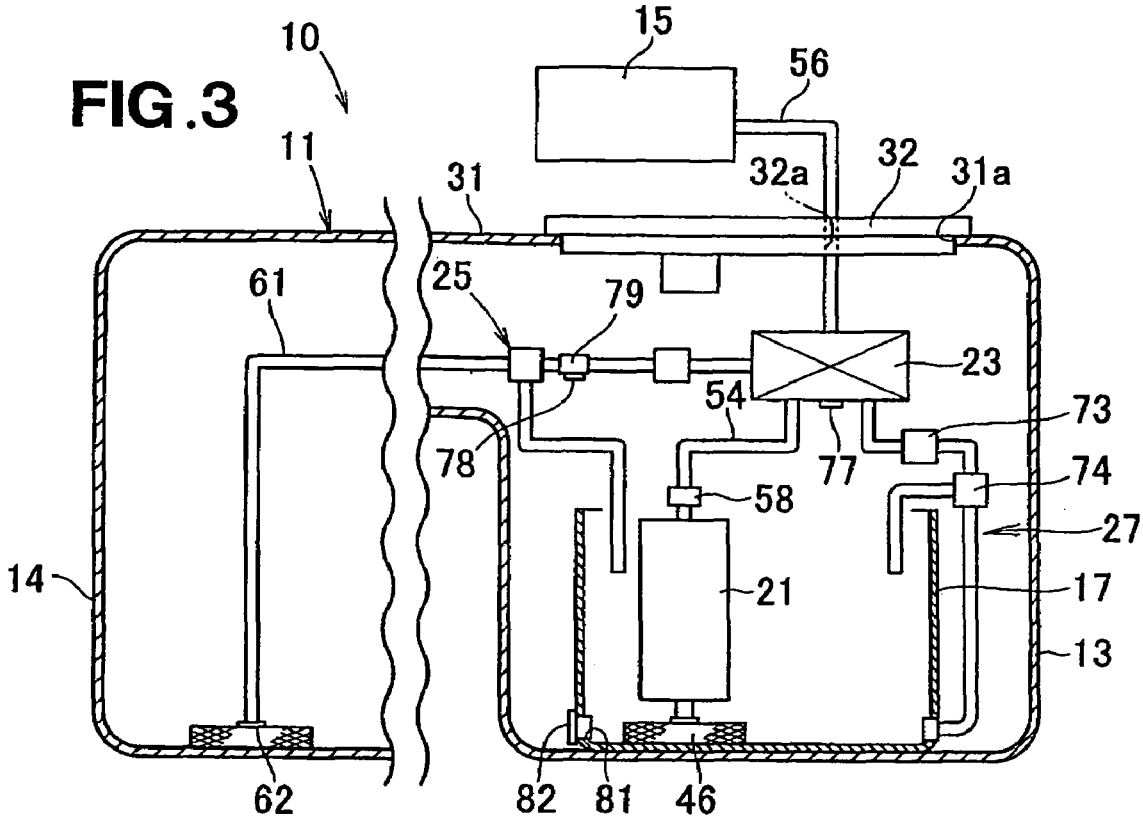
FIG. 3 is a schematic view showing the fuel supply device of FIG. 1, modified for use in a fuel-saving engine.

Referring to FIGS. 1 to 3, a vehicle fuel supply device 10 according to the first embodiment will be described.

As shown in FIG. 1, in the vehicle fuel supply device 10 of the first embodiment, two chambers that include a main chamber 13 and an auxiliary chamber 14 are formed for storing fuel 12 in a saddle fuel tank 11, and the fuel 12 stored in the chambers 13, 14 is fed to an engine 15.

The vehicle fuel supply device 10 includes a reservoir 17 disposed within the main chamber 13; a main pump 21 and a sub-pump 22 provided within the reservoir 17; a strainer 23 that is provided within the saddle fuel tank 11 and communicated with the main pump 21 and the sub-pump 22; a transfer jet means 25 communicated with the strainer 23; and a first return jet means (return jet means) 26 and a second return jet means 27.

The vehicle fuel supply device 10 can easily be modified to adapt to a high-output engine or a fuel-saving engine.

A vehicle fuel supply device 10 adapted for a high-output engine is shown in FIG. 1.

A vehicle fuel supply device 10 adapted for a fuel-saving engine has the configuration shown in FIG. 1, except that the sub-pump 22 and the first return jet means 26 are omitted (see FIG. 3).

In the saddle fuel tank 11, the main chamber 13 is formed on the right side of the vehicle, the auxiliary chamber 14 is formed on the left side of the vehicle, and a space through which a propeller shaft 29 passes is formed in the center.

In the saddle fuel tank 11, an open part 31*a* is formed in the top part (ceiling part) 31, and a cover 32 is detachably screwed in the open part 31*a*.

The main pump 21 and the sub-pump 22 are thus provided together within the reservoir 17 on the side of the main chamber 13. Therefore, a single cover 32 is sufficient for the main chamber 13, and the structure is simplified.

In contrast, a main pump and a sub-pump may be provided to the main chamber and the auxiliary chamber, for example. In this case, covers must be provided for the main chamber and the auxiliary chamber, resulting in a more complex structure.

An example is shown in which the air-liquid separation valve (float valve) 34 of the saddle fuel tank 11 is provided to the cover 32, but this configuration is not limiting, and the air-liquid separation valve 34 may also be provided directly to the tank 11. The air-liquid separation valve 34 maintains a state of ventilation between the outside and the inside of the saddle fuel tank 11 during normal operation, and closes only when fuel is introduced by a flow channel to prevent fuel from flowing to the outside.

The reservoir 17 is provided within the main chamber 13, and is a chamber in which a space 38 is formed by a bottom part 36 and a peripheral wall 37. A pair of attachment parts 39, 39 is provided to the peripheral wall 37. The lower ends of attachment rods 41, 41 are passed through passage holes 39*a*, 39*a* of the attachment parts 39, 39.

The upper ends of the attachment rods 41, 41 are attached to the cover 32. Compression springs 42, 42 are provided to the attachment rods 41, 41. The bottom part 36 of the reservoir 17 is pushed against the bottom part 43 of the main chamber 13 by the force of the compression springs 42, 42. The reservoir 17 is thereby stabilized within the main chamber 13.

The main pump 21 is driven in the period from the time of normal engine speed to the time of high engine speed, and the fuel 12 stored within the reservoir 17 is drawn up. A time of high engine speed is a state in which the maximum fuel consumption due to engine driving is high. A time of normal engine speed is a state in which the maximum fuel consumption is low during engine driving. The main pump 21 is connected to a main filter 46 via a main fuel pumping channel 45.

The sub-pump 22 is an auxiliary fuel pump that drives in times of high engine speed and draws up the fuel 12 stored in the reservoir 17. The sub-pump 22 is connected to an auxiliary filter 48 via an auxiliary fuel pumping channel 47.

The strainer 23 has a strainer main body 52 that is accommodated in a case 51. The strainer 23 is communicated with the main pump 21 via a main pumping pipe 54, and is communicated with the sub-pump 22 via an auxiliary pumping pipe 55. The strainer 23 is connected to the engine 15 via a feeding pipe 56. The strainer main body 52 removes foreign matter included in the fuel 12, and an example of the strainer main body 52 is a mesh filter formed in a substantially cylindrical shape.

Since the strainer 23 is thus connected to the main pump 21 via the main pumping pipe 54, and to the sub-pump 22 via the auxiliary pumping pipe 55, there is no need to communicate the auxiliary pumping pipe 55 with the main pumping pipe 54 using a three-way joint. The three-way joint is therefore unnecessary, and the number of parts can be reduced.

Furthermore, the strainer 23 in the vehicle fuel supply device 10 is disposed within the saddle fuel tank 11. For example, when a three-way joint is used, the three-way joint must be disposed within the saddle fuel tank 11, and a space for the three-way joint must be maintained. Eliminating the need for a three-way joint eliminates the need to maintain the space for placement of the three-way joint, and makes it possible to eliminate layout limitations and to increase the degree of freedom of design.

The strainer 23 is disposed within the saddle fuel tank 11, and the single feeding pipe 56 for communicating the strainer 23 with the engine 15 extends from the inside of the saddle fuel tank 11 to the outside. An attachment hole 32*a* is formed in the cover 32, and the feeding pipe 56 is passed through the attachment hole 32*a*, whereby the strainer 23 is communicated with the engine 15.

When the number of fuel pumps (i.e., the vehicle specifications) is selected according to the requirements of a high-output engine or a fuel-saving engine, the modification can thus be performed merely by replacing parts within the saddle fuel tank 11. An example of selecting the vehicle specifications according to the requirements of a high-output engine or a fuel-saving engine will be described in detail using FIG. 3.

A main pumping check valve 58 is provided to a midportion of the main pumping pipe 54. An auxiliary pumping check valve 59 is provided to a midportion of the auxiliary pumping pipe 55. The main pumping check valve 58 and the auxiliary pumping check valve 59 cause some fuel pressure to remain in the area between the strainer 23 and the engine 15 after the engine 15 is stopped.

The transfer jet means 25 includes a first transfer pipe 61 connected to the strainer 23; a transfer filter 62 provided to the distal end of the first transfer pipe 61; a transfer jet 63 provided to a midportion of the first transfer pipe 61; and a second transfer pipe 64 connected to the transfer jet 63.

A transfer-return check valve 65 is provided between the strainer 23 and the transfer jet 63 in the first transfer pipe 61. The transfer-return check valve 65 causes some fuel pressure to remain in the area between the strainer 23 and the engine 15 after the engine 15 is stopped.

A negative pressure occurs in the transfer jet 63 when excess fuel 12 of the fuel 12 pumped to the engine 15 by the main pump 21 and the sub-pump 22 via the strainer 23 is returned to the reservoir 17 through the transfer jet 63 and the second transfer pipe 64 in the region from normal engine speed to high engine speed. The negative pressure generated by the transfer jet 63 draws in the fuel 12 in the auxiliary chamber 14 and transfers the fuel 12 in the auxiliary chamber 14 to the main chamber 13 (to the reservoir 17). The excess fuel 12 that is branched from the strainer 23 may be fuel (dirty-side fuel) prior to passing through a filter provided in the strainer 23, or fuel (clean-side fuel) that has passed through the filter.

In the first return jet means 26, a return pipe 67 is communicated between the transfer-return check valve 65 and the transfer jet 63 via a coupling 79 in the first transfer pipe 61. A first return jet 68 is provided to the lower end of the return pipe 67.

In the first return jet means 26, the first return jet 68 is negatively pressurized by the excess fuel 12 from the strainer 23, and the first return jet means 26 utilizes the negative pressure to direct the fuel 12 in the main chamber 13 into the reservoir 17 in the region from normal engine speed to high engine speed.

In the second return jet means 27, a return pipe 71 for high engine speed is communicated with the strainer 23, and a second return jet 72 is provided to the lower end of the return pipe 71.

A pressure regulator 73 is provided to a midportion of the return pipe 71. Furthermore, a relief valve 74 is provided between the pressure regulator 73 and the second return jet 72 in the return pipe 71. A relief pipe 75 is connected to the relief valve 74.

The pressure regulator 73 is composed of a valve that is communicated with the strainer 23, adjusts the internal pressure of the strainer 23 to a set value, and leads to the return pipe 71 in order to return the excess fuel 12 to the reservoir 17.

In the second return jet means 27, a negative pressure is generated in the second return jet 72 by the excess fuel 12 from the pressure regulator 73, and the second return jet means 27 utilizes the generated negative pressure to direct the fuel 12 in the main chamber 13 into the reservoir 17.

The relief valve 74 normally releases the back pressure of the second return jet 72 while the second return jet 72 operates in normal conditions.

An example in which fuel 12 is fed to the engine 15 by the vehicle fuel supply device 10 will next be described based on FIGS. 2A and 2B.

FIG. 2A shows an example in which the engine 15 is driven at a normal engine speed, and FIG. 2B shows an example in which the engine 15 is driven at a high engine speed.

Of the main pump 21 and the sub-pump 22, only the main pump 21 is driven in FIG. 2A (driving during normal engine speed).

When the main pump 21 is driven, the fuel 12 in the reservoir 17 is drawn up by the main pump 21 via the main filter 46 and the main fuel pumping channel 45.

The drawn-up fuel 12 is directed to the strainer 23 via the main pumping check valve 58 and the main pumping pipe 54 as indicated by the arrow A. Almost all of the fuel 12 directed to the strainer 23 proceeds on to the feeding pipe 56, and the excess fuel 12 is directed (branched) to the first transfer pipe 61. The fuel 12 directed to the feeding pipe 56 is fed to the engine 15 via the feeding pipe 56 as indicated by the arrow B.

The excess fuel 12 directed to the first transfer pipe 61 is directed via the transfer-return check valve 65 as indicated by the arrow C. A portion of the excess fuel 12 that passes through the transfer-return check valve 65 is directed to the return pipe 67 as indicated by the arrow D, and the remaining fuel 12 is directed to the transfer jet 63.

The fuel 12 directed to the return pipe 67 is directed into the reservoir 17 via the first return jet 68 as indicated by the arrow E. In this state, a negative pressure is generated in the first return jet 68. The fuel 12 in the main chamber 13 is drawn into the reservoir 17, as indicated by the arrow F, by the generated negative pressure. Specifically, the first return jet means 26 utilizes the negative pressure generated in the first return jet 68 to direct the fuel 12 in the main chamber 13 into the reservoir 17 as indicated by the arrow F.

The fuel 12 directed to the transfer jet 63 is directed to the second transfer pipe 64 as indicated by the arrow G. In this state, a negative pressure is generated in the transfer jet 63. The fuel 12 in the auxiliary chamber 14 is drawn up into the first transfer pipe 61 via the transfer filter 62 by the generated negative pressure.

The drawn-up fuel 12 flows through the first transfer pipe 61, as indicated by the arrow H, and proceeds to the transfer jet 63. The fuel 12 directed to the transfer jet 63 is directed (transferred), as indicated by the arrow I, into the reservoir 17 via the second transfer pipe 64. Specifically, the transfer jet means 25 utilizes the negative pressure generated in the transfer jet 63 to transfer the fuel 12 in the auxiliary chamber 14 into the reservoir 17 as indicated by the arrow I.

In FIG. 2A, since the fuel consumption of the engine 15 is low, the pressure inside the strainer 23 is brought to the set value by drawing up the fuel 12 from the main pump 21. The pressure regulator 73 then opens, and a portion of the fuel 12 within the strainer 23 is directed to the return pipe 71 as indicated by the arrow K. The fuel 12 directed to the return pipe 71 is directed as indicated by the arrow L into the reservoir 17 via the relief valve 74 and the second return jet 72.

In this state, a negative pressure is generated in the second return jet 72. The fuel 12 in the main chamber 13 is drawn into the reservoir 17, as indicated by the arrow M, by the generated negative pressure. Specifically, the second return jet means 27 utilizes the negative pressure generated in the second return jet 72 to introduce the fuel 12 in the main chamber 13 into the reservoir 17 as indicated by the arrow M. The appropriate amount of fuel 12 can thereby be fed to the engine 15 during times of normal engine speed.

The relief valve 74 opens when the second return jet 72 is blocked by dirt or the like. The fuel 12 in the return pipe 71 is returned to the reservoir 17 via the relief pipe 75, as indicated by the arrow N, by the opening of the relief valve 74.

In FIG. 2B, the sub-pump 22 is driven along with the main pump 21.

The fuel 12 in the reservoir 17 is drawn up by the sub-pump 22 via the auxiliary filter 48 and the auxiliary fuel pumping channel 47 by the driving of the sub-pump 22. The drawn-up fuel 12 is directed as indicated by the arrow J to the strainer 23 via the auxiliary pumping check valve 59 and the auxiliary pumping pipe 55.

In the strainer 23, the fuel merges with the fuel directed from the main pump 21.

The strainer 23 has a large space in comparison with the inside diameter of the main pumping pipe 54 or the auxiliary pumping pipe 55. The fuel 12 thus flows from the main pumping pipe 54 or the auxiliary pumping pipe 55 to the strainer 23 and merges in the strainer 23, whereby the pulsation of the main pump 21 and the sub-pump 22 is absorbed by the large space of the strainer 23.

The fuel 12 that has merged in the strainer 23 is directed by the feeding pipe 56 and fed to the engine 15 as indicated by the arrow B. Fuel in which the pulsation of the main pump 21 and the sub-pump 22 is suppressed can thereby be fed to the engine 15.

The fuel 12 drawn up by both pumps 21, 22 is also fed to the engine 15 in the same manner as the flow shown in FIG. 2A, the excess fuel is returned to the reservoir 17, and the fuel 12 in the main chamber 13 is directed into the reservoir 17 in the state shown in FIG. 2B as well, in which the main pump 21 and the sub-pump 22 are driven.

As described above, the vehicle fuel supply device 10 according to the first embodiment is provided with first and second return jet means 26, 27 for directing the fuel 12 in the main chamber 13 into the reservoir 17 from the time of normal engine speed to the time of high engine speed. The fuel 12 in the main chamber 13 can thereby be satisfactorily introduced into the reservoir 17, even when the amount of remaining fuel 12 stored in the saddle fuel tank 11 (particularly the main chamber 13) is small, by operating the first and second return jet means 26, 27 from the time of normal engine speed to the time of high engine speed.

Since an adequate amount of fuel 12 can be stored in the reservoir 17 in this manner, the fuel 12 can be satisfactorily drawn into the reservoir 17 by the main pump 21 and the sub-pump 22. The fuel 12 can thereby be even more stably fed to the engine 15 from the main pump 21 and the sub-pump 22.

An example in which the vehicle fuel supply device 10 is adapted to a fuel-saving engine will next be described based on FIG. 3.

The engine shown in FIG. 3 is a fuel-saving engine, and the vehicle fuel supply device 10 is therefore provided with only the main pump 21. Specifically, only the main pump 21 is provided in the reservoir 17, and the sub-pump 22 and first return jet means 26 shown in FIG. 1 are not installed.

In this case, a port (not shown) for communicating the auxiliary pumping pipe 55 with the strainer 23 is blocked by a first plug 77. A port (not shown) communicated with the first return jet means 26 (see FIG. 1) of the coupling 79 is also blocked by a second plug 78.

Furthermore, an open part 81 in which the first return jet 68 (see FIG. 1) is provided to the peripheral wall of the reservoir 17 is blocked by a third plug 82.

When the vehicle fuel supply device 10 is adapted to a high-output engine, the sub-pump 22 is provided in the reservoir 17, and the auxiliary pumping pipe 55 in place of the first plug 77 is communicated with the strainer 23. The first return jet means 26 (see FIG. 1) is attached in place of the second plug 78, and the first return jet 68 (see FIG. 1) is provided in place of the third plug 82 to the open part 81.

Specifically, the vehicle fuel supply device 10 is configured so that the main pump 21 is communicated with the strainer 23 via the main pumping pipe 54, and the sub-pump 22 can be communicated with the strainer 23 via the auxiliary pumping pipe 55. The strainer 23 is provided within the saddle fuel tank 11. When the number of fuel pumps (i.e., the vehicle specifications) is selected in accordance with the requirements of a high-output engine or a fuel-saving engine, the vehicle fuel supply device 10 can be modified merely by replacing parts inside the saddle fuel tank 11. The parts that are replaced are the sub-pump 22, the auxiliary pumping pipe 55, the first return jet means 26, and the first through third plugs 77, 78, 82.

A fuel supply device for a saddle fuel tank adapted for a high-output engine is usually provided with fuel pumps in the main chamber and the auxiliary chamber of the saddle fuel tank, and covers for supporting the fuel pumps are provided to the top parts of the main chamber and the auxiliary chamber. A passage hole for inserting a main pumping pipe is formed in one of the covers, and a passage hole for inserting an auxiliary pumping pipe is formed in the other cover.

Therefore, there is no passage hole formed in the other cover when a sub-pump or an auxiliary pumping pipe is not attached to the other cover. Accordingly, a modification must be made in this case so that there is no need to support a fuel tank. Furthermore, a new means must be added for transferring the fuel of the auxiliary chamber to the main chamber.

In contrast, in the vehicle fuel supply device 10 according to the first embodiment, there is no need to replace the relatively large cover 32 used in the saddle fuel tank 11 in conjunction with a change in the number of fuel pumps 21, 22.

Furthermore, since the transfer jet means 25 is already provided as a transfer means, there is no need to add a new means for transferring the fuel 12 of the auxiliary chamber 14 to the main chamber 13.

Consequently, the vehicle fuel supply device 10 can be adapted to a high-output engine or a fuel-saving engine to easily modify the vehicle specifications.

The fuel supply device 100 according to a second embodiment will next be described in detail based on FIG. 4. In the second embodiment, the same reference symbols are used to refer to members that are the same or similar to those of the vehicle fuel supply device 10 of the first embodiment, and no redundant description will be given.

The fuel supply device 100 according to the second embodiment includes an intropipeion flapper 101, a transfer jet means 102, and a return jet means 103. Other aspects of the structure are the same as in the vehicle fuel supply device 10 according to the first embodiment.

The fuel supply device 100 can easily be modified to adapt to a high-output engine or a fuel-saving engine.

Figure 4:
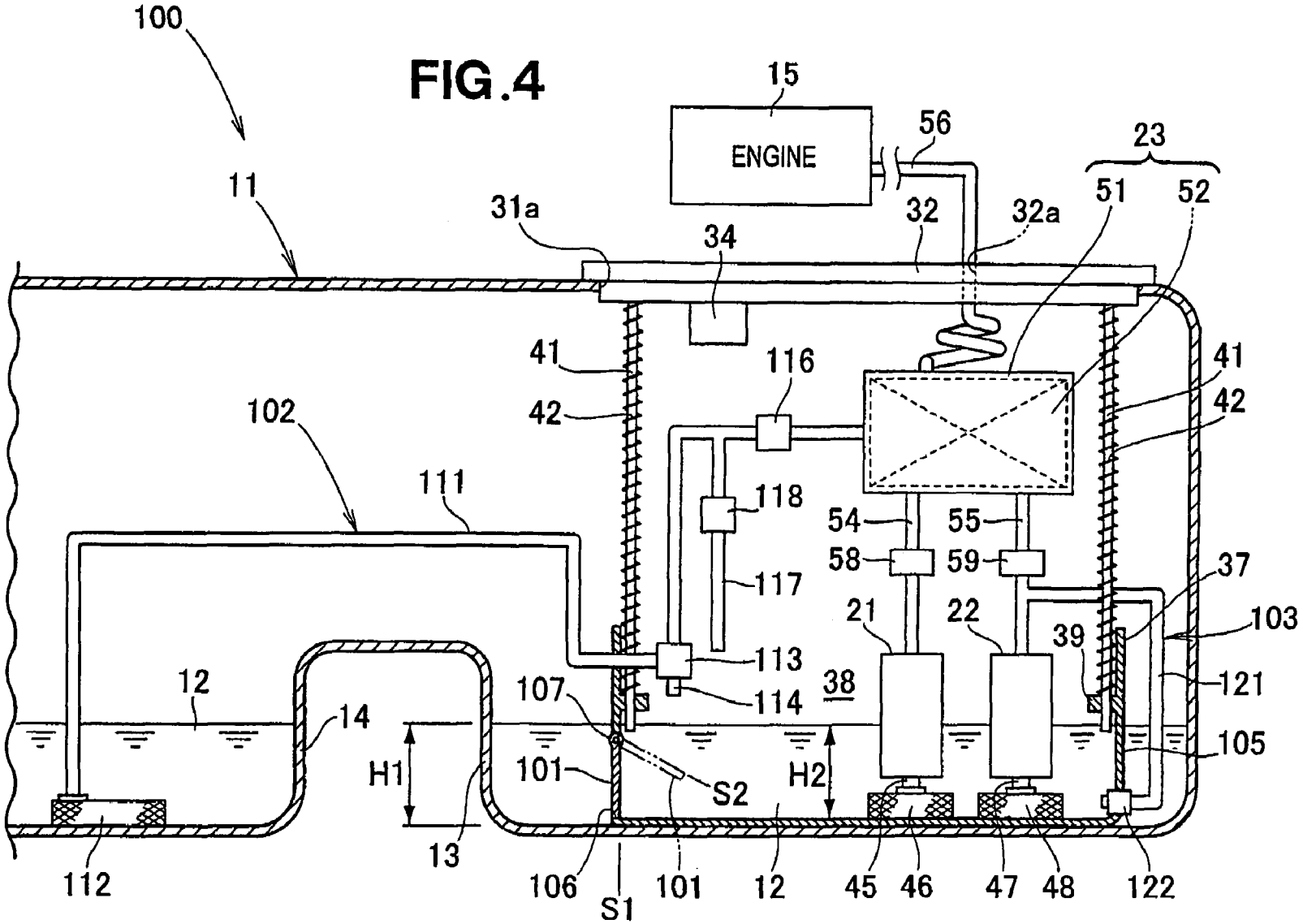
FIG. 4 is a schematic view showing a vehicle fuel supply device according to a second embodiment of the present invention.

FIG. 4 shows a fuel supply device 100 adapted for a high-output engine. A vehicle fuel supply device 100 adapted for a fuel-saving engine has the configuration shown in FIG. 4, except that the sub-pump 22 and the return jet means 103 are omitted.

The reservoir 105 is formed by providing the intropipeion flapper 101 to the reservoir 17 of the first embodiment. Other aspects of the structure thereof are the same as in the reservoir 17 of the first embodiment.

The intropipeion flapper 101 is a flap for opening and closing an open part 106 of the peripheral wall 37. The intropipeion flapper 101 is supported by the peripheral wall 37 so as to be able to pivot between a closed position S1 and an open position S2 about a support pin 107 at the upper end thereof.

When the fuel height H1 in the main chamber 13 is greater than the fuel height H2 in the reservoir 105, the fuel pressure in the main chamber 13 is higher than the fuel pressure in the reservoir 105, and the intropipeion flapper 101 therefore pivots upward. The open part 106 of the peripheral wall 37 is opened. The fuel 12 in the main chamber 13 is thereby directed into the reservoir 105 via the open part 106.

When the fuel height H1 in the main chamber 13 is the same as the fuel height H2 in the reservoir 105, the fuel pressure in the main chamber 13 is the same as the fuel pressure in the reservoir 105, and the intropipeion flapper 101 pivots downward due to the weight thereof. The open part 106 of the peripheral wall 37 is closed by the intropipeion flapper 101. The fuel 12 is thereby prevented from flowing back into the main chamber 13 from the reservoir 105.

The transfer jet means 102 has a first transfer pipe 111 connected to the strainer 23; a transfer filter 112 connected to the proximal end of the first transfer pipe 111; a transfer jet 113 provided to a midportion of the first transfer pipe 111; and a second transfer pipe 114 connected to the transfer jet 113.

A pressure regulator 116 is provided to the first transfer pipe 111 between the transfer jet 113 and the strainer 23. A relief valve 118 is provided to a midportion of a relief pipe 117 that branches from the first transfer pipe 111.

The pressure regulator 116 is composed of a valve that is communicated with the strainer 23, adjusts the internal pressure of the strainer 23 to a set value, and returns excess fuel 12 to the reservoir 105.

In the transfer jet means 102, a negative pressure is generated in the transfer jet 113 by the excess fuel 12 from the pressure regulator 116, and the transfer jet means 102 utilizes the generated negative pressure to transfer the fuel 12 in the auxiliary chamber 14 to the reservoir 105 in the main chamber 13.

The relief valve 118 normally releases the back pressure of the transfer jet 113 while the transfer jet 113 operates in normal conditions.

The return jet means 103 includes a return pipe 121 connected to a midportion of the auxiliary pumping pipe 55, and a return jet 122 provided to the distal end of the return pipe 121.

At times of high engine speed, the return jet means 103 generates a negative pressure in the return jet 122 by using fuel 12 diverted from the upstream side (i.e., the auxiliary pumping pipe 55) of the strainer 23, and utilizes the generated negative pressure to introduce the fuel 12 in the main chamber 13 into the reservoir 105.

An example in which fuel 12 is fed to the engine 15 by the fuel supply device 100 according to the second embodiment will next be described based on FIGS. 5A, 5B and 6.

Figure 5A:
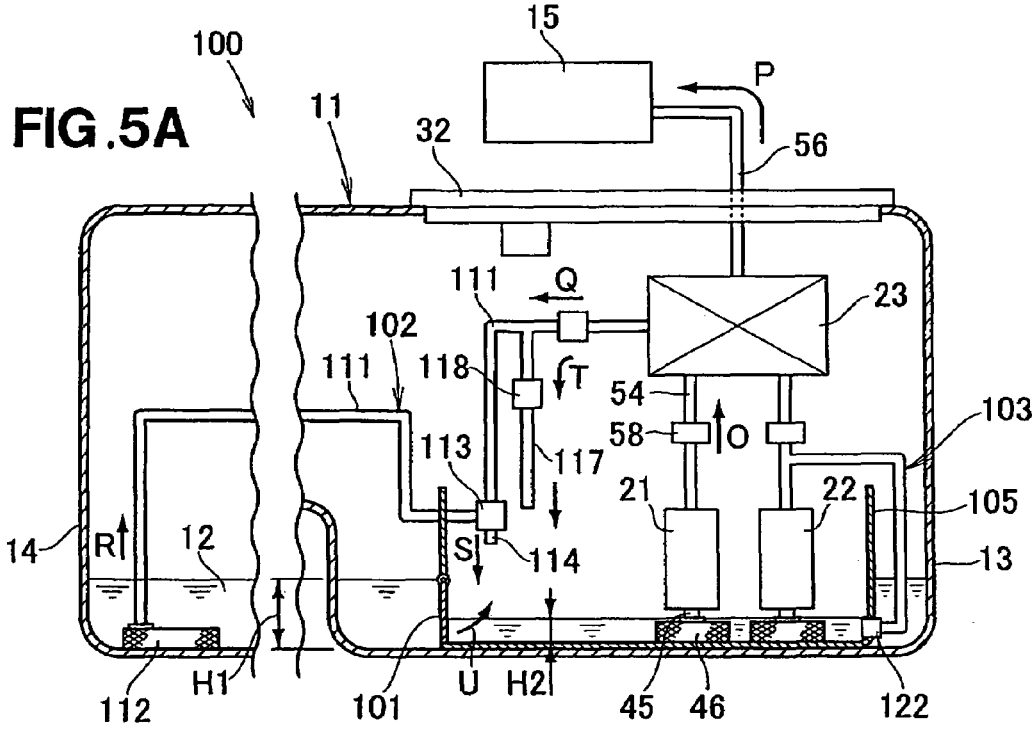
FIGS. 5A and 5B are schematic views showing an example of feeding fuel to the engine during normal engine speed by the fuel supply device according to the second embodiment.
Figure 5B:
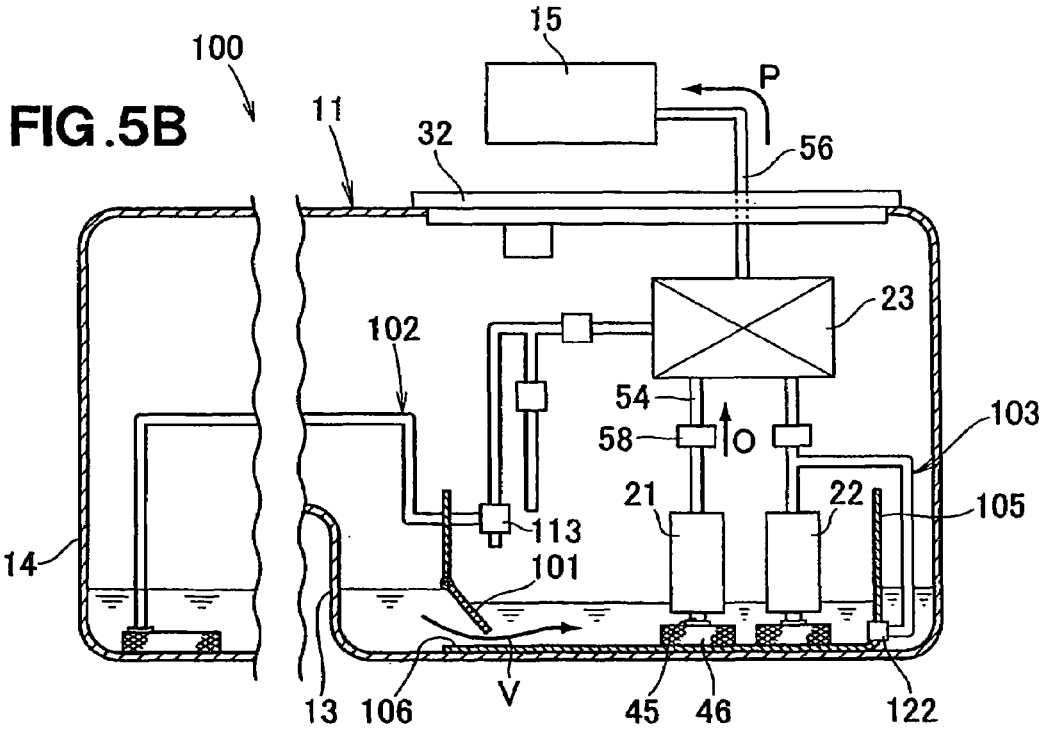

FIGS. 5A and 5B show an example in which fuel is fed to the engine at a time of normal engine speed by the fuel supply device according to the second embodiment.

Of the main pump 21 and the sub-pump 22, only the main pump 21 is driven in FIG. 5A.

When the main pump 21 is driven, the fuel 12 in the reservoir 105 is drawn up by the main pump 21 via the main filter 46 and the main fuel pumping channel 45.

The drawn-up fuel 12 is directed to the strainer 23 via the main pumping check valve 58 and the main pumping pipe 54 as indicated by the arrow O. The fuel 12 directed to the strainer 23 is fed to the engine 15 via the feeding pipe 56 as indicated by the arrow P.

The pressure inside the strainer 23 is brought to the set value through by drawing up the fuel 12 from the main pump 21 to the strainer 23. The pressure regulator 116 then opens, and the excess fuel 12 from the fuel fed to the engine 15 in the strainer 23 is directed to the first transfer pipe 111 as indicated by the arrow Q. The excess fuel 12 directed to the first transfer pipe 111 is directed into the reservoir 105 via the transfer jet 113 and the second transfer pipe 114.

In this state, a negative pressure is generated in the transfer jet 113. The generated negative pressure is utilized to draw the fuel 12 in the auxiliary chamber 14 into the first transfer pipe 111 via the transfer filter 112.

The indrawn fuel 12 flows through the first transfer pipe 111, as indicated by the arrow R, and proceeds to the transfer jet 113. The fuel 12 directed to the transfer jet 113 is transferred into the reservoir 105 via the second transfer pipe 114 as indicated by the arrow S. Specifically, the transfer jet means 102 utilizes the negative pressure generated in the transfer jet 113 to transfer the fuel 12 in the auxiliary chamber 14 to the reservoir 105 as indicated by the arrow S.

When the relief valve 118 opens, the fuel 12 in the first transfer pipe 111 is directed to the relief pipe 117 as indicated by the arrow T. The fuel 12 directed to the relief pipe 117 is directed through the relief valve 118 into the reservoir 105 as indicated by the arrow.

The amount of fuel 12 in the reservoir 105 decreases, and the fuel height H2 in the reservoir 105 drops below the fuel height H1 in the main chamber 13. The fuel pressure in the main chamber 13 exceeds the fuel pressure in the reservoir 105, and the intropipeion flapper 101 pivots upward, as indicated by the arrow U.

As shown in FIG. 5B, when the intropipeion flapper 101 pivots upward, the open part 106 is opened. The fuel 12 in the main chamber 13 flows through the open part 106 into the reservoir 105, as indicated by the arrow V, and accumulates in the reservoir 105. During times of normal engine speed, the fuel 12 in the reservoir 105 is drawn up by the main pump 21, and the appropriate amount of fuel 12 is fed to the engine 15.

Figure 6:
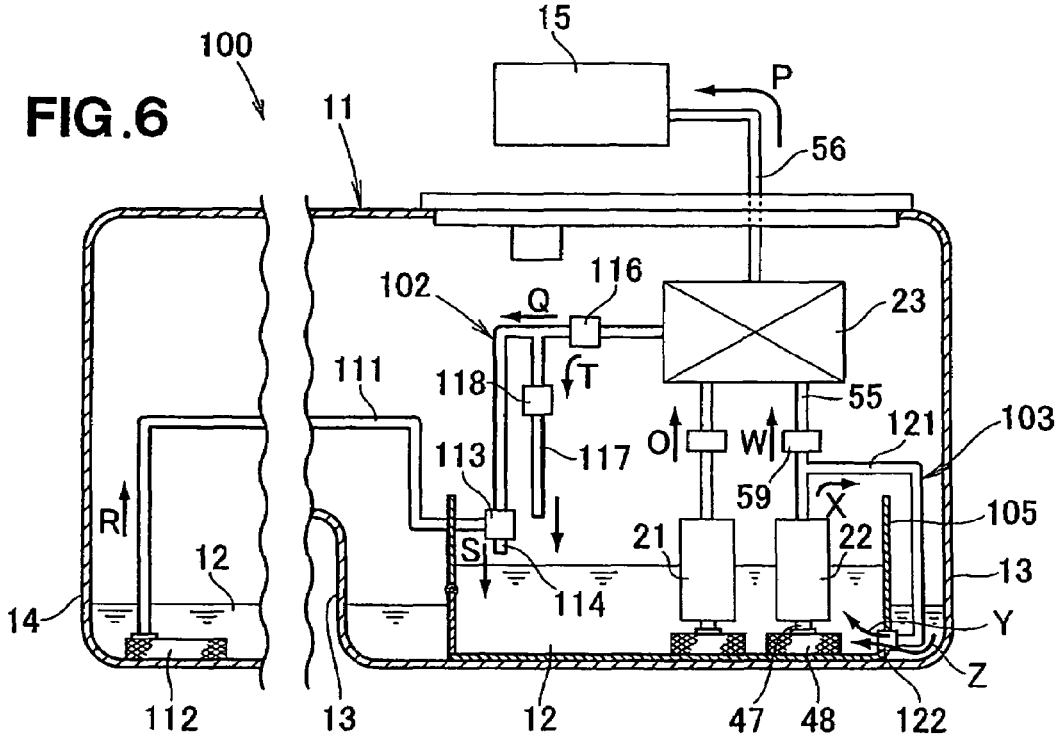
FIG. 6 is a diagrammatical view showing an example of feeding fuel to the engine during high engine speed by the fuel supply device according to the second embodiment.

FIG. 6 shows an example in which fuel is fed by the fuel supply device according to the second embodiment to the engine at a time of high engine speed.

The sub-pump 22 is also driven in addition to the main pump 21.

Through the driving of the sub-pump 22, the fuel 12 in the reservoir 105 is drawn up by the sub-pump 22 via the auxiliary filter 48 and the auxiliary fuel pumping channel 47.

The drawn-up fuel 12 is directed to the strainer 23, as indicated by the arrow W, via the auxiliary pumping check valve 59 and the auxiliary pumping pipe 55; and a portion of the fuel 12 is directed to the return pipe 121 as indicated by the arrow X.

The fuel 12 directed to the strainer 23 is merged in the strainer 23 with the fuel directed from the main pump 21.

The strainer 23 has a large space in comparison with the inside diameter of the main pumping pipe 54 or the auxiliary pumping pipe 55. The fuel 12 thus flows from the main pumping pipe 54 or the auxiliary pumping pipe 55 to the strainer 23, and merges in the strainer 23, whereby the pulsation of the main pump 21 and the sub-pump 22 is absorbed by the large space of the strainer 23.

The fuel 12 that has merged in the strainer 23 is directed by the feeding pipe 56 and fed to the engine 15 as indicated by the arrow P. Fuel in which the pulsation of the main pump 21 and the sub-pump 22 is suppressed can thereby be fed to the engine 15.

The fuel 12 directed to the return pipe 121 as indicated by the arrow X is directed into the reservoir 105 via the return jet 122 as indicated by the arrow Y. In this state, a negative pressure is generated in the return jet 122. The generated negative pressure is utilized to introduce the fuel 12 in the main chamber 13 into the reservoir 105 as indicated by the arrow Z.

The return jet means 103 utilizes the negative pressure generated in the pumping jet 122 to introduce the fuel 12 in the main chamber 13 into the reservoir 105 as indicated by the arrow Z. Fuel 12 is thereby maintained in the reservoir 105 at times of high engine speed, and the appropriate amount of fuel 12 can be fed to the engine 15.

As described above, the fuel supply device 100 according to the second embodiment is provided with a transfer jet means 102 for transferring the fuel 12 in the auxiliary chamber 14 to the reservoir 105 in the main chamber 13 from the time of normal engine speed to the time of high engine speed. Furthermore, a return jet means 103 is provided for drawing the fuel in the main chamber 13 into the reservoir 105 at times of high engine speed.

Since a state of normal engine speed is established when the engine 15 is started, only the main pump 21 is driven. Particularly at such times as engine 15 startup, the pressure regulator 116 is not operated when the fuel pressure is below the set value. All of the fuel 12 drawn up by the main pump 21 can thereby be fed to the engine 15.

The fuel 12 drawn up by the main pump 21 can thus be fed to the engine 15 without modification, and better startup properties of the engine 15 can be maintained even when the battery voltage is low during low-temperature startup, for example.

Furthermore, since the return jet means 103 is not operated when the engine speed is normal, the fuel 12 drawn up by the main pump 21 can be satisfactorily fed to the engine 15.

As previously mentioned, the fuel supply device 100 can be modified to correspond to a high-output engine or a fuel-saving engine.

Figure 7:
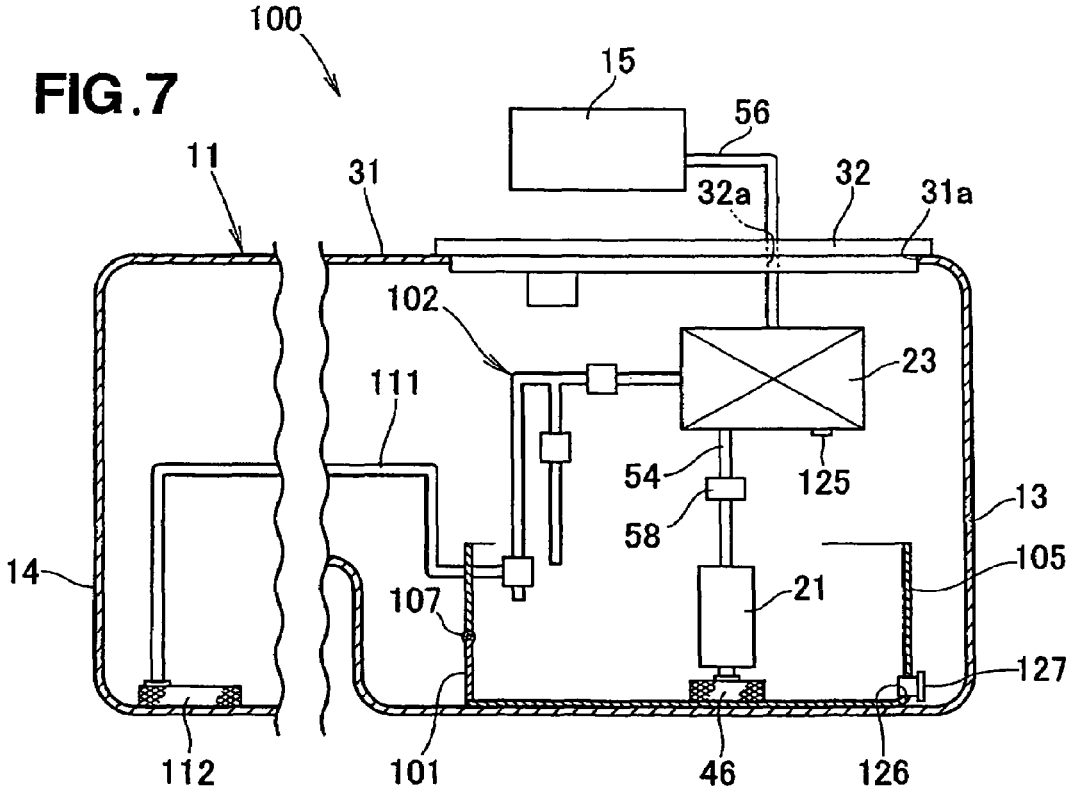
FIG. 7 is a schematic view showing a state in which the fuel supply device according to the second embodiment is adapted to a fuel-saving engine.

An example of installing the fuel supply device 100 according to the second embodiment adapted for a fuel-saving engine will be described hereinafter based on FIG. 7.

Since the engine is a fuel-saving engine, the fuel supply device 100 is provided only with the main pump 21. Specifically, only the main pump 21 is provided in the reservoir 105, and the sub-pump 22 and return jet means 103 shown in FIG. 4 are not installed.

In this case, a port (not shown) for communicating the auxiliary pumping pipe 55 with the strainer 23 is blocked by a first plug 125. An open part 126 provided to the return jet 122 (FIG. 4) in the peripheral wall of the reservoir 105 is blocked by a second plug 127.

In the vehicle fuel supply device 100 adapted for a high-output engine, the sub-pump 22 is provided in the reservoir 105, and the auxiliary pumping pipe 55 in place of the first plug 125 is communicated with the port of the strainer 23. The return jet 122 is provided to the open part 126 in place of the second plug 127.

In the fuel supply device 100, the main pump 21 can thus be communicated with the strainer 23 via the main pumping pipe 54, the sub-pump 22 can be communicated via the auxiliary pumping pipe 55, and the strainer 23 is provided within the saddle fuel tank 11.

When the number of fuel pumps (i.e., the vehicle specifications) is selected in accordance with the requirements of a high-output engine or a fuel-saving engine, the vehicle fuel supply device 100 can be modified merely by replacing parts inside the saddle fuel tank 11. The parts that are replaced are the sub-pump 22, the auxiliary pumping pipe 55, the pumping jet means 103, and the first and second plugs 125, 127.

There is thus no need to replace the relatively large cover 32 used in the saddle fuel tank 11 according to a change in the number of fuel pumps 21, 22, the same as in the fuel supply device 10 according to the first embodiment shown in FIG. 1. Specifications of the fuel supply device 10 that conform to the requirements of a high-output engine or a fuel-saving engine can be easily modified.

Examples were described in the first and second embodiments in which the fuel 12 of the auxiliary chamber 14 is transferred to the reservoirs 17, 105 of the main chamber 13, but this configuration is not limiting, and the fuel 12 of the auxiliary chamber 14 may also be transferred into the main chamber 13.

The present invention is suitable for application to an automobile that is provided with a fuel supply device for supplying an engine with fuel stored in a main chamber and an auxiliary chamber of a saddle fuel tank.

Obviously, various minor changes and modifications of the present invention are possible in light of the above teaching. It is therefore to be understood that within the scope of the appended claims the invention may be practiced otherwise than as specifically described.

What is claimed is:

1. A vehicle fuel supply device including a saddle-shaped fuel tank which is comprised of a main chamber and an auxiliary chamber for storing fuel to be fed to an engine, the vehicle fuel supply device comprising:

a reservoir disposed within the main chamber;

a main pump provided within the reservoir, for drawing up the fuel of the reservoir by driving in a period from a time of normal speed of the engine to a time of high engine speed;

a sub-pump detachably provided within the reservoir, for drawing up the fuel in the reservoir by driving in the time of high engine speed;

a strainer provided within the fuel tank and communicating with the main pump via a main pumping pipe, with the sub-pump via an auxiliary pumping pipe, and with the engine via a supply pipe;

a pressure regulator communicating with the strainer, for adjusting an internal pressure of the strainer to a set value and returning excess fuel to the reservoir from among the fuel that is drawn up by the pumps; and transfer means for transferring the fuel from the auxiliary chamber into the reservoir within the main chamber.

2. The fuel supply device of claim 1, wherein the transfer means comprises:

transfer jet means for, in a region from normal speed to high speed of the engine, utilizing a negative pressure generated through the use of excess fuel among the fuel drawn up by the main pump and transferring the fuel from the auxiliary chamber to the reservoir; and return jet means for, in the region from normal speed to high speed of the engine, generating a negative pressure by a portion of the excess fuel and utilizing the generated negative pressure to direct the fuel in the main chamber into the reservoir.

3. The fuel supply device of claim 1, wherein the transfer means comprises:

transfer jet means for utilizing a negative pressure generated through the use of excess fuel from the pressure regulator and transferring the fuel from the auxiliary chamber to the reservoir; and return jet means for, at the time of high engine speed, generating a negative pressure using a portion of the fuel drawn up by the sub-pump and utilizing the generated negative pressure to direct the fuel in the main chamber into the reservoir.

* * * * *

UNITED STATES PATENT AND TRADEMARK OFFICE

CERTIFICATE OF CORRECTION

PATENT NO. : 7,500,473 B2
APPLICATION NO. : 12/079346
DATED : March 10, 2009
INVENTOR(S) : Kobayashi et al.

It is certified that error appears in the above-identified patent and that said Letters Patent is hereby corrected as shown below:

On the Title Pg.

Add Item (30) Foreign Application Priority Data
March 26, 2007 (JP).....2007-080218

Signed and Sealed this

Twenty-eighth Day of April, 2009

John Doll

JOHN DOLL
*Acting Director of the United States Patent and Trademark Office*